US009702174B2

(12) United States Patent
Hatton et al.

(10) Patent No.: US 9,702,174 B2
(45) Date of Patent: Jul. 11, 2017

(54) DOOR BRACE

(75) Inventors: James Hatton, St. Leonards-on-Sea (GB); Steve St. James, Encinitas, CA (US)

(73) Assignee: PENN ELCOM CORPORATION, Tortola (VG)

( * ) Notice: Subject to any disclaimer, the term of this patent is extended or adjusted under 35 U.S.C. 154(b) by 174 days.

(21) Appl. No.: 14/366,802

(22) PCT Filed: Dec. 20, 2011

(86) PCT No.: PCT/GB2011/052533

§ 371 (c)(1),
(2), (4) Date: Sep. 30, 2014

(87) PCT Pub. No.: WO2013/093390

PCT Pub. Date: Jun. 27, 2013

(65) Prior Publication Data

US 2015/0042109 A1 Feb. 12, 2015

(51) Int. Cl.
*E05B 17/20* (2006.01)
*E05C 19/18* (2006.01)
(Continued)

(52) U.S. Cl.
CPC ..... *E05C 19/188* (2013.01); *E05C 17/44* (2013.01); *E05C 17/443* (2013.01); *E05C 17/48* (2013.01);
(Continued)

(58) Field of Classification Search
CPC ..... Y10S 292/15; E05C 17/54; E05C 19/184; E05C 17/446; E05C 19/18; Y10T 292/67; Y10T 16/61; Y10T 292/34; Y10T 16/6285
(Continued)

(56) References Cited

U.S. PATENT DOCUMENTS 217,762 A 7/1879 Witte
692,687 A 2/1902 Martin
(Continued)

FOREIGN PATENT DOCUMENTS

EP 2386707 11/2011
WO 2013093390 6/2013

OTHER PUBLICATIONS

Office Action dated Jan. 28, 2015 for U.S. Appl. No. 14/002,689.
(Continued)

*Primary Examiner* — Mark Williams
(74) *Attorney, Agent, or Firm* — Fleit Gibbons Gutman Bongini & Bianco PL; Paul D. Bianco; Katharine Wong Davis

(57) ABSTRACT

A door brace (10) comprising a door engagement member (12), a leg (20) and an engagement foot (26). The door engagement member (12) comprises a bottom flange (14) for location under a bottom edge of a door (34) and an engagement wall (16) having one face (18) for location against one side of the door. The leg comprises a fixed length section (22)and an adjustable length section (24). The leg is hingedly connected to the engagement wall and is movable between a bracing position in which it extends at a first angle to the engagement wall and a released position in which it extends at a smaller angle to the engagement wall. The door brace has a released condition in which the leg is in the released position and the adjustable length section of the leg has a first length and a bracing condition in which the leg is in the bracing position and the adjustable length section of the leg has a longer length.

5 Claims, 6 Drawing Sheets

(51) Int. Cl.

| | |
|---|---|
| ***E05C 17/44*** | (2006.01) |
| ***E05C 17/54*** | (2006.01) |
| ***E05C 19/00*** | (2006.01) |
| ***E05C 17/48*** | (2006.01) |
| ***E05C 17/50*** | (2006.01) |

(52) U.S. Cl.
CPC ..... *E05C 17/50* (2013.01); *E05C 17/54* (2013.01); *E05C 19/004* (2013.01); *E05C 19/18* (2013.01); *E05C 19/182* (2013.01); *Y10T 292/34* (2015.04); *Y10T 292/67* (2015.04)

(58) Field of Classification Search
USPC ..... 292/288, DIG. 15
See application file for complete search history.

(56) References Cited

U.S. PATENT DOCUMENTS

| | | | | | |
|---|---|---|---|---|---|
| 943,401 | A | | 12/1909 | Ehermann | |
| 1,064,320 | A | | 6/1913 | Glindkamp | |
| 1,687,517 | A | * | 10/1928 | Sasgen | E05C 17/443 292/238 |
| 1,830,296 | A | | 11/1931 | Siino | |
| 2,058,639 | A | | 10/1936 | Shoolman et al. | |
| 2,073,024 | A | | 3/1937 | Potter | |
| 2,774,622 | A | | 12/1956 | Priebe | |
| 2,798,755 | A | | 7/1957 | Zapotocny | |
| 3,731,341 | A | | 5/1973 | Woodruff | |
| 4,076,293 | A | | 2/1978 | Valles | |
| 4,421,348 | A | * | 12/1983 | Kahn | E05C 19/004 292/339 |
| 4,666,195 | A | | 5/1987 | Thomas, III | |
| 4,759,577 | A | | 7/1988 | Thomas, III | |
| 5,064,232 | A | | 11/1991 | Quarberg | |
| 5,207,464 | A | | 5/1993 | Reeves, Jr. | |
| 5,503,443 | A | | 4/1996 | Tautfest | |
| 5,601,319 | A | | 2/1997 | Morin | |
| 7,938,461 | B2 | * | 5/2011 | Ollinger | E05C 17/44 16/82 |
| 8,496,278 | B2 | | 7/2013 | Lee | |
| 2004/0070217 | A1 | | 4/2004 | Demlow | |
| 2008/0309100 | A1 | | 12/2008 | Ollinger | |
| 2011/0278866 | A1 | | 11/2011 | Lee | |
| 2012/0080891 | A1 | | 4/2012 | Bravo | |
| 2014/0375070 | A1 | | 12/2014 | Hatton | |

OTHER PUBLICATIONS

Response filed Apr. 28, 2015 to Office Action dated Jan. 28, 2015 for U.S. Appl. No. 14/002,689.
Final Office Action dated Aug. 11, 2015 for U.S. Appl. No. 14/002,689.
Response filed Oct. 13, 2015 to Final Office Action dated Aug. 11, 2015 for U.S. Appl. No. 14/002,689.
Advisory Action dated Nov. 4, 2015 for U.S. Appl. No. 14/002,689.
International Search Report for PCT/IB2011/052533 dated Aug. 21, 2012.
IPR International Preliminary Report for PCT/IB2011/052533 dated Jul. 3, 2014.

* cited by examiner

DOOR BRACE

TECHNICAL FIELD

The invention relates to a door brace.

BACKGROUND

It can be desirable in many situations to increase the security on a door by, for example, installing a stronger lock or additional locks or bolts at additional locking points around the door. However, it is not always possible or convenient to make these types of permanent installations on a door, for example in a rented home or office, a hotel or hostel room, or in student accommodation. In situations such as these it is desirable to increase the security of a door using non-permanent means. One well known method is to jam a chair under the door handle but unless the chair is of the right size and construction this will not hold the door for long. One solution which has been proposed extends this approach of jamming a door closed by locating a bar at an angle between the door handle and the floor behind the door. While this is an improvement over the use of a chair, the connection between the bar and the door handle is prone to failure and the bar can extend significantly beyond the door, presenting a trip hazard.

An aspect of the invention provides a door brace comprising a door engagement member, a leg and an engagement foot. The door engagement member comprises a bottom flange and an engagement wall. The bottom flange is adapted to be located under a bottom edge of a door. The engagement wall extends generally upwardly from the bottom flange and has one face adapted to be located against part of one side of the door. The leg comprises a fixed length section and an adjustable length section. The fixed length section has one end hingedly connected to an opposite face of the engagement wall such that the leg is movable between a bracing position in which the leg extends at a first angle to the engagement wall and a released position in which the leg extends at a second, smaller angle to the engagement wall. The adjustable length section is provided at a distal end of the fixed length section and has a length adjustable between a first length and a second, longer length. The engagement foot is provided at a distal end of the adjustable length section of the leg. The door brace has a bracing condition in which the leg is in the bracing position and the adjustable length section of the leg has the second length. The door brace has a released condition in which the leg is in the released position and the adjustable length section of the leg has the first length.

The angle of the leg in the bracing condition is set by a user moving the leg into the bracing position. Unlike the prior art, the user is not required to select the angle that the leg should have in the bracing condition but merely to move the leg into the bracing position, which has a preselected angle. This may ensure that the leg is arranged at an optimal angle in the bracing condition, to provide optimal bracing to the door. The construction of the door brace for location against part of a lower edge of a door may enable the door brace to be of a smaller size than the prior art devices which engage with a door handle. This may increase the portability of the door brace and may make it more convenient for a user to carry the door brace with them to, for example, secure the door of a room in a hostel, hotel or student accommodation.

In an embodiment, the fixed length section of the leg has an angled shape. This may provide improved compactness of the door brace.

In an embodiment, the fixed length section of the leg comprises a first part extending generally in a first direction and a second part extending generally in a second direction. In the bracing position, the first part extends at a first angle to the face of the engagement wall and the second part extends at a second, smaller angle to the face of the engagement wall.

In an embodiment, the second angle is between 10 degrees and 15 degrees. This may provide optimal engagement of the engagement foot with the floor without transmitting an excessive force on the leg, which may cause mechanical failure of the leg.

In an embodiment, the door brace further comprises an adjustable clamp between the leg and the engagement wall. This may provide additional strength to the leg in the bracing position.

In an embodiment, the fixed length section of the leg is substantially straight and the door brace further comprises a lever arm. The lever arm is hingedly connected at a first hinge point to the opposite face of the engagement wall. The fixed length section of the leg is hingedly connected at a second hinge point to the lever arm. The lever arm is movable between an open position in which the leg is in the released position and a locked position in which the leg is in the bracing position and the second hinge point is located closer to the engagement wall than the first hinge point. The lever arm may enable the length of the leg to be set to the longer length, by varying the length of the adjustable length section, while the leg is in the released position. This may provide increased engagement between the foot and the floor.

In an embodiment, the engagement wall and the bottom flange of the door engagement member define a generally L-shaped recess for receiving part of a door at a bottom edge of the door. The door brace may therefore be closely located against the door, for optimal engagement between the door brace and the door.

In an embodiment, the engagement foot has a sole on which a non-slip material is provided. The non-slip material may be one of a rubber pad and a neoprene elastomer pad. The non-slip material may improve the engagement between the foot and the floor. In an embodiment, the engagement foot is rotatably mounted on the adjustable length section of the leg. The angle of engagement between the engagement foot and the floor may optimised by rotating the foot.

In an embodiment, the adjustable length section of the leg comprises a threaded bolt mounted in a correspondingly threaded socket in the fixed length section of the leg. A strong mechanical coupling may therefore be provided between the adjustable length section and the fixed length section of the leg, which will resist downwards force applied through the leg.

DETAILED DESCRIPTION

Figure 1:
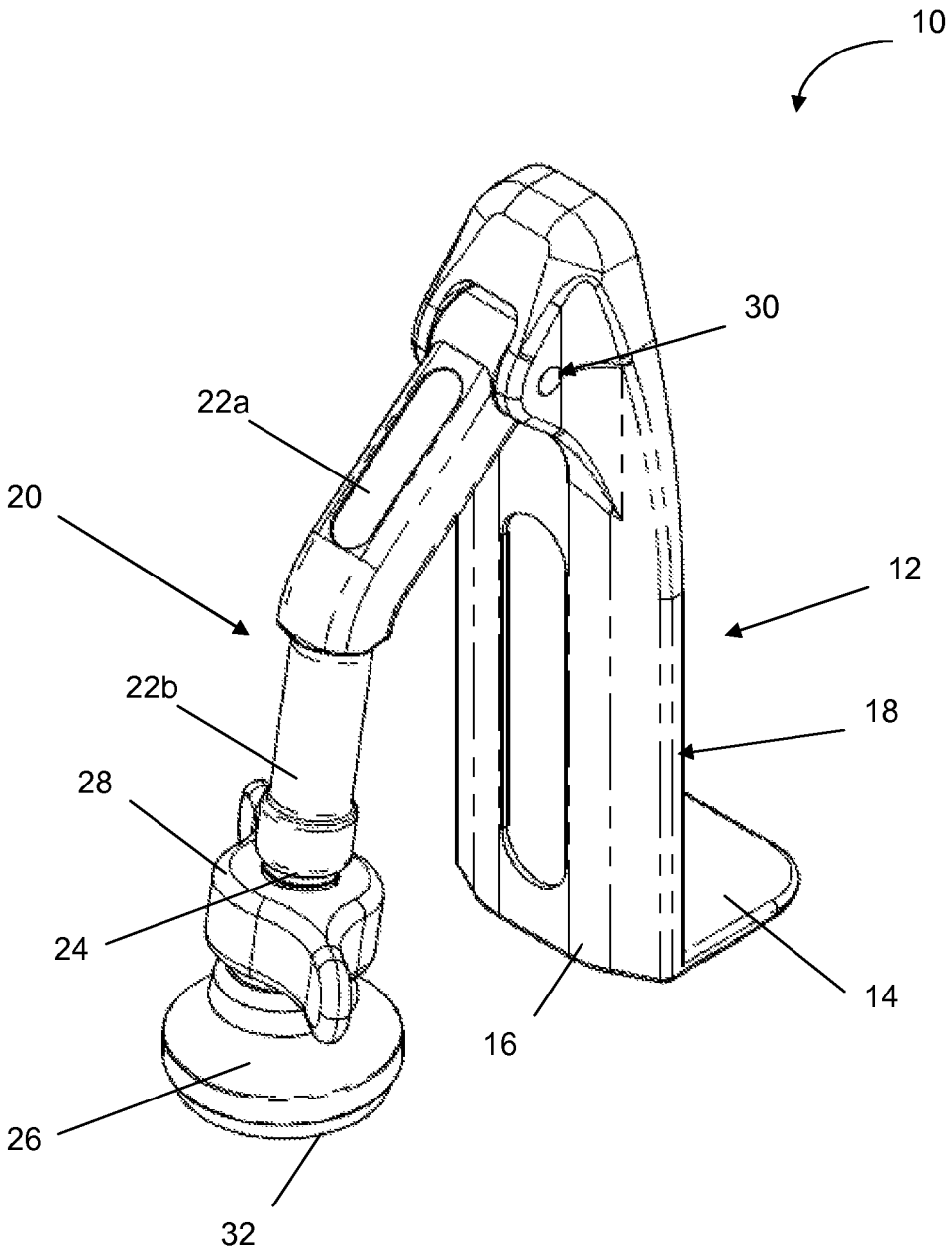
FIG. 1 is a perspective view of a door brace according to a first embodiment of the invention, in the bracing condition.
Figure 2:
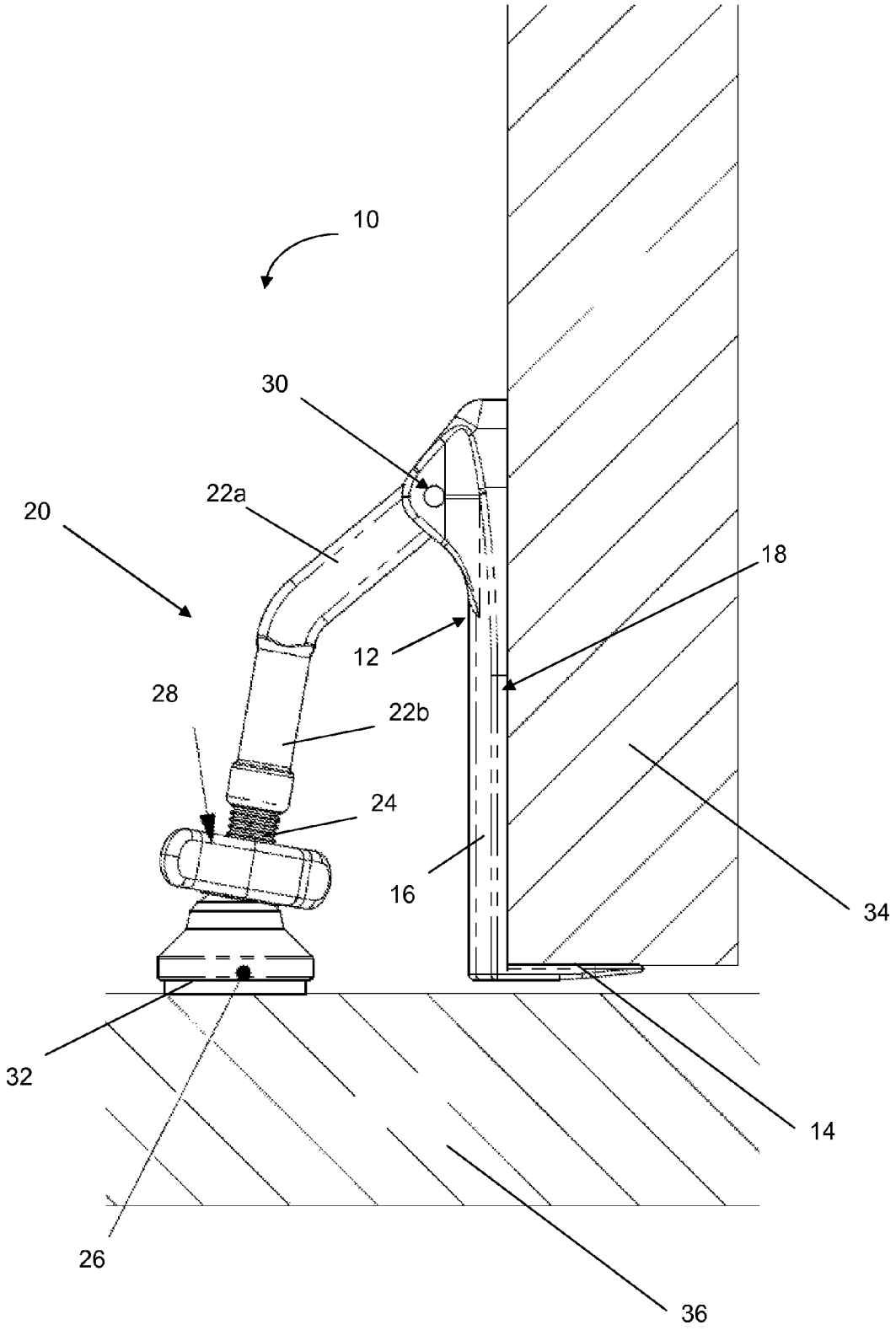
FIG. 2 is a side view of the door brace of FIG. 1 located against a door.
Figure 3:
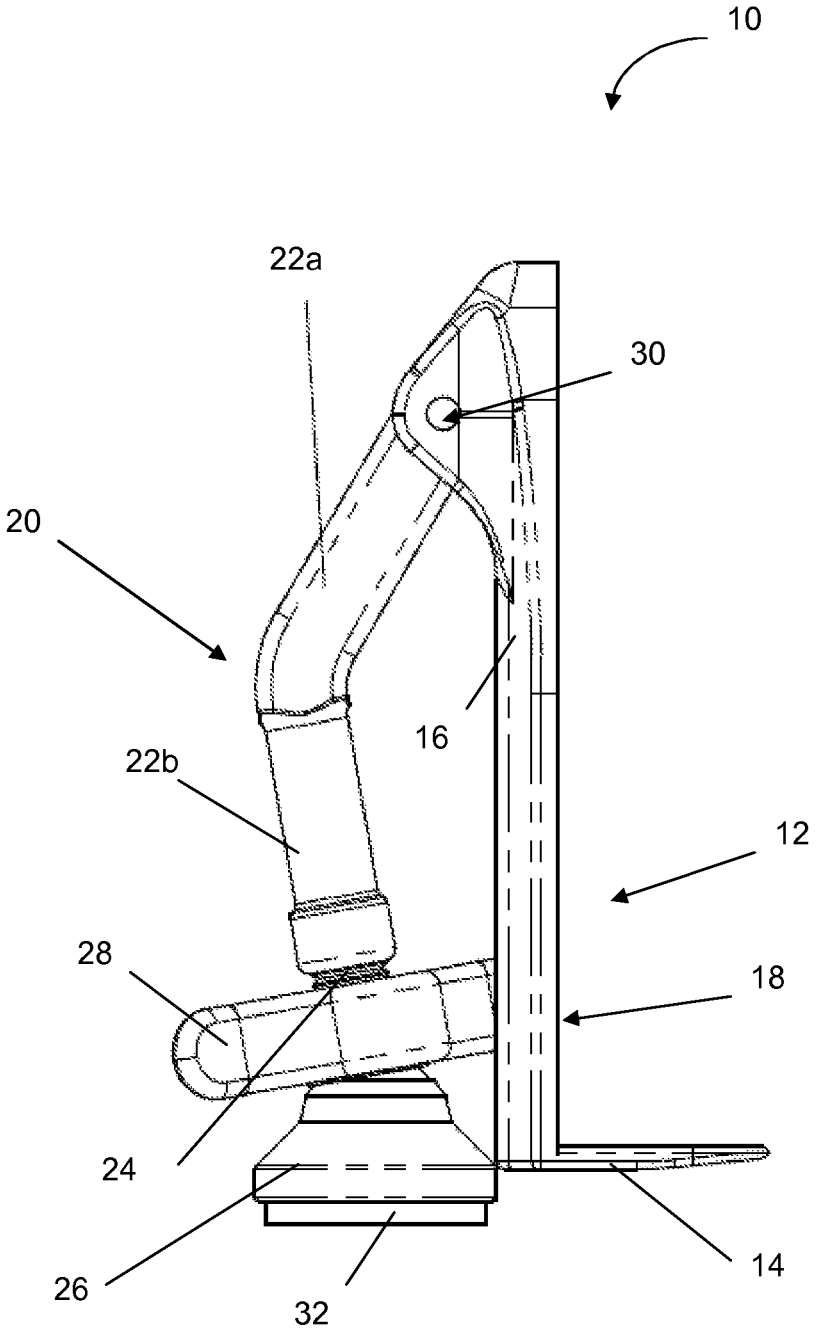
FIG. 3 is a side view of the door brace of FIG. 1 in the released condition.

Referring to FIGS. 1 to 3, a first embodiment of the invention provides a door brace 10 comprising a door engagement member 12, a leg 20 and an engagement foot 26.

The door engagement member 12 comprises a bottom flange 14 and an engagement wall 16. The bottom flange 14 is adapted to be located under a bottom edge of a door, as shown in FIG. 2. The engagement wall 16 extends generally upwardly from the bottom flange 14. One face 18 of the engagement wall is adapted to be located against part of one side of the door, at the bottom edge, as shown in FIG. 2. In this example, the engagement wall 16 and the bottom flange 14 together define a generally L-shaped recess for receiving part of the door at its bottom edge.

The leg 20 comprises a fixed length section 22 and an adjustable length section 24. In this embodiment, the fixed length section 22 has an angled shape and comprises a first part 22*a* and a second part 22*b*. The first part 22*a* extends in a first elongate direction and the second part 22*b* extends in the second elongate direction. With reference to FIGS. 1 and 2, in the bracing position, the first part extends at a first angle to the face 18 of the engagement wall 16 and the second part 22*b* extends at a second, smaller angle to the face of the engagement wall. In this example, as seen most clearly in FIG. 2, the first part 22*a* of the fixed length section 22 extends at an angle of substantially 45 degrees to the face 18 of the engagement wall 16. This may ensure that the maximum component of any force applied to the face 18 of the engagement wall 16, by a potential intruder pushing on the door 34, is transmitted down the leg 20 to the foot 26 and into the floor 36. The second part 22*b* extends at an angle of between 10 degrees and 15 degrees to the engagement wall 16, and therefore is angled also relative to the first part 22*a*. In this example, the second part 22*b* extends at an angle of approximately 10 degrees but it will be appreciated that any angle between 10 degrees and 15 degrees may be used. An angle of less than 15 degrees may ensure that the engagement foot 26 does not slip on the floor under force applied against the door. An angle of 10 degrees or more may ensure that the second part 22*b* of the leg does not experience stress beyond its maximum tolerance (the level of stress beyond which the leg 22 will mechanically fail). The angle of the second part 22*b* may therefore be chosen to be as close to 10 degrees as possible, to optimise the bracing or jamming between the door brace 10 and the floor, without causing stress above its maximum tolerance.

The fixed length section of the leg is hingedly connected 30 at one end of its first part 22*a* to the opposite face of the engagement wall 16. The leg 20 is therefore moveable relative to the door engagement member 12 and in particular is moveable between a bracing position, as shown in FIGS. 1 and 2, and a released position, as shown in FIG. 3. In the bracing position the leg 20 extends at a first angle to the engagement wall 16 and in the released position the leg 20 extends at a smaller angle to the engagement wall 16. In this example, in the bracing position the leg 20 is spaced from the engagement wall 16 and in the released position the foot 26 is located generally adjacent to, or at least at a smaller spacing from, the engagement wall 16.

The adjustable length section 24 is provided at the distal end of the fixed length section 22. In this example, the adjustable length section 24 comprises a threaded bolt which is located in a correspondingly threaded aperture within the second part 22*b* of the fixed length section of the leg 20. The adjustable length section is provided with a wing nut 28 (56 in second embodiment) which may be turned to cause the threaded bolt to move into or out of the fixed length section 22 to shorten or lengthen the adjustable length section as required. The total length of the leg 20 may therefore be adjusted by varying the length of the adjustable-length section.

In this example, the foot 26 is provided with a pad 32 of non-slip material, such as rubber or neoprene elastomer on its sole, to provide additional resistance to force applied to the door brace 10.

The door brace 10 has a bracing condition, shown in FIGS. 1 and 2, in which the leg 20 is located in its bracing position and the adjustable length section 24 of the leg has its second, longer, length. The door brace 10 also has a released condition, as shown in FIG. 3, in which the leg 20 is in its released position and the adjustable length section 24 of the leg has had its length shortened to the first length.

In use, with the door brace 10 in its released condition, as shown in FIG. 3, the bottom flange 14 is located underneath the bottom rail or the lower edge of a stile of the door 34 and the door brace is pushed towards the door until the face 18 of the engagement wall 16 is located against part of one side of the door 34. The leg 20 is then moved from its released position into its bracing position, as shown in FIG. 2. The length of the adjustable length section 24 of the leg 20 is then increased to its second, longer length, by turning the wing-nut 28, and the non-slip pad 32 on the engagement foot 26 is brought into secure engagement with the floor 36. In this bracing condition a force applied against the door 34, from the side opposite to the one on which the door brace 10 is located, is transferred into the door brace 10 and a downwards component of the force is exerted downwardly through the leg 20 and the engagement foot 26, into the floor 36. Application of external force to the door 34 therefore increases the strength of the engagement of the door brace 10 between the door 34 and the floor 36.

Figure 4:
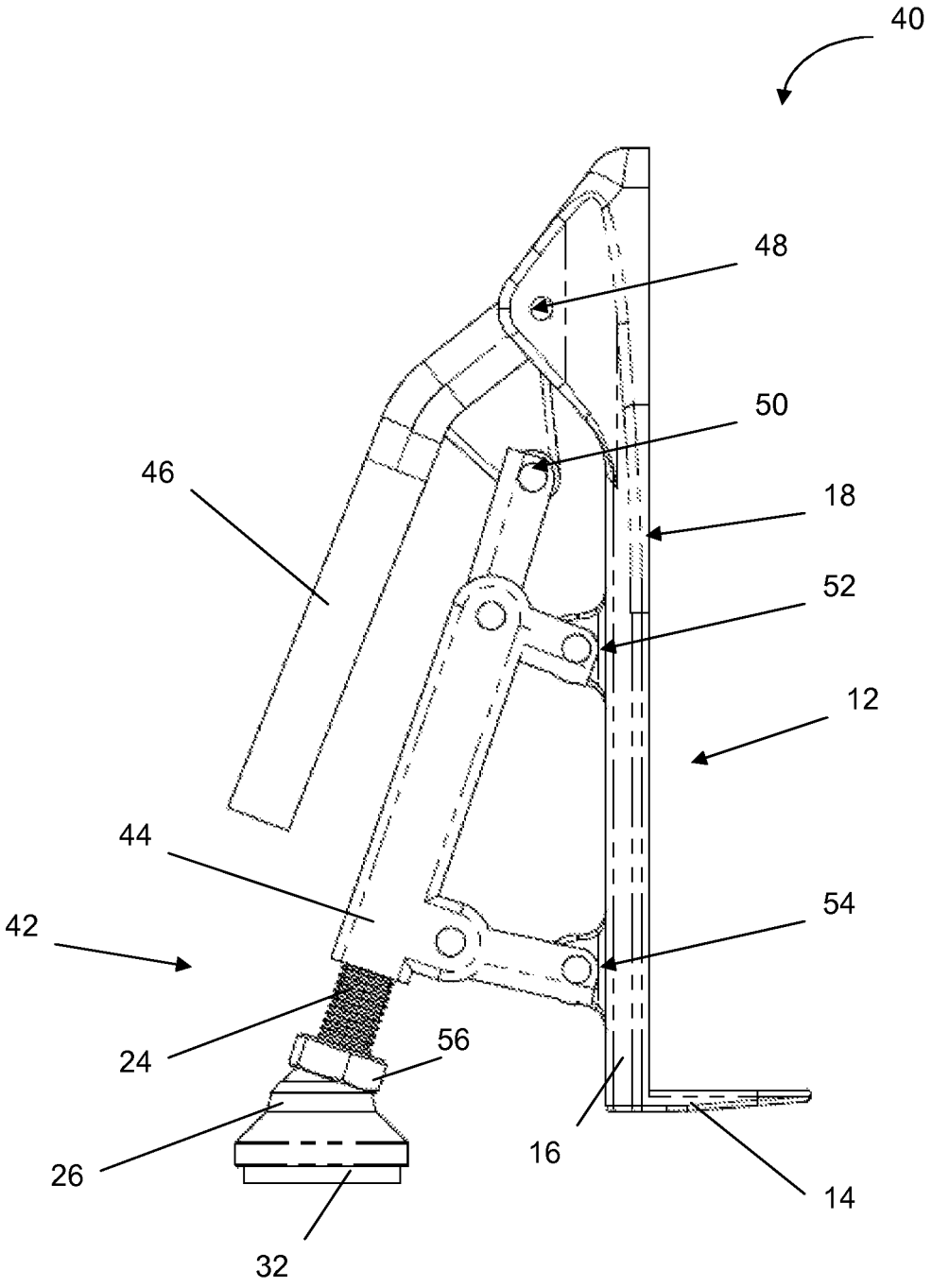
FIG. 4 is a side view of a door brace according to a second embodiment of the invention, in the bracing condition.
Figure 5:
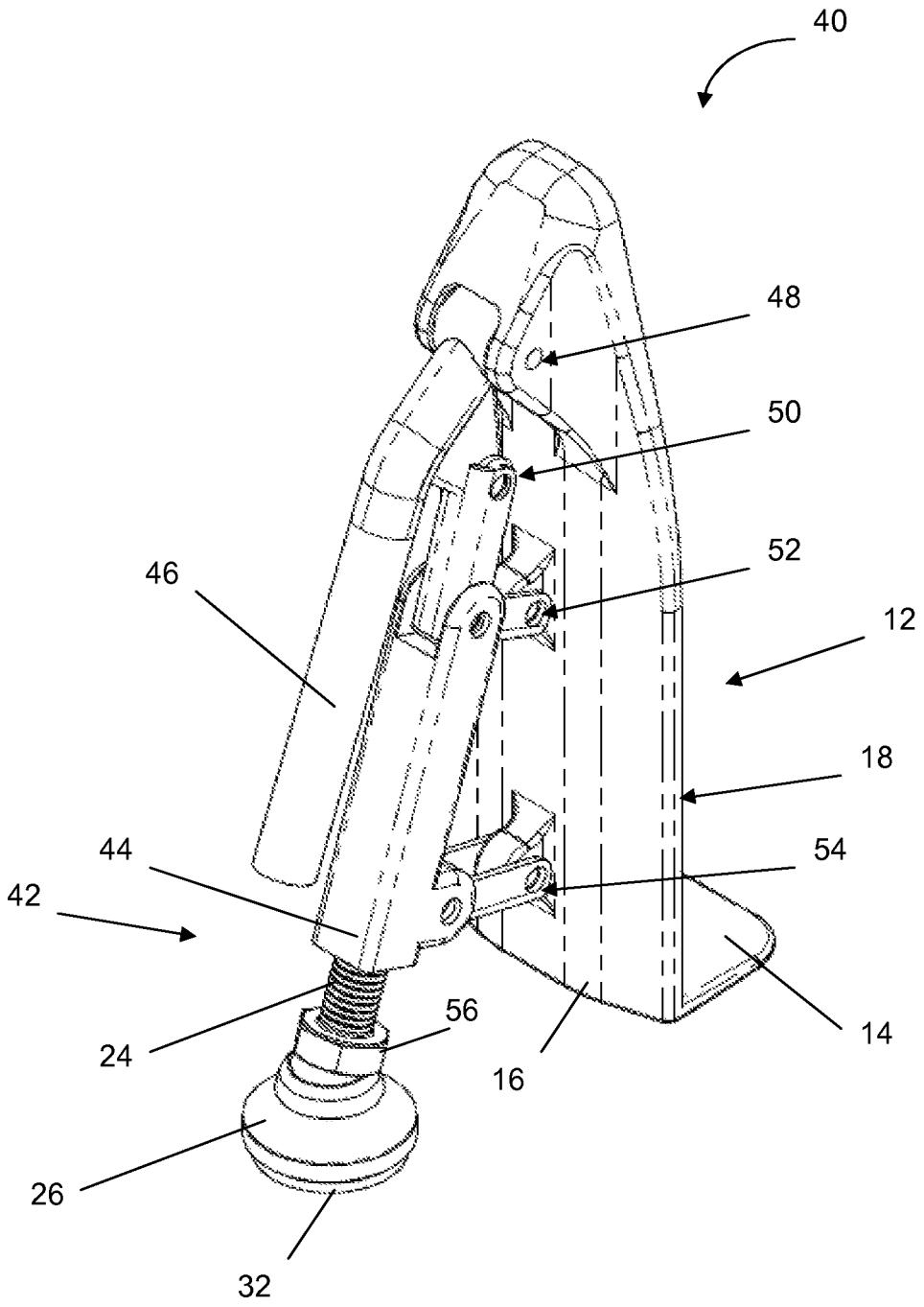
FIG. 5 is a perspective view of the door brace of FIG. 4.

A door brace 40 according to a second embodiment of the invention is shown in FIGS. 4 and 5. The door brace 40 of this embodiment is similar to the door brace 10 of FIGS. 1 to 3, with the following modifications. The same reference numbers are retained for corresponding features.

In this embodiment, the fixed length section 44 of the leg 42 is substantially straight and the door brace 40 further comprises a lever-arm 46. The lever-arm 46 is hingedly connected to the engagement wall 16 at first hinge point 48, which is located at a first separation from the face 18 of the engagement wall 16. The fixed length section 44 of the leg is hingedly connected to the lever-arm 46 at a second hinge point 50. The second hinge point 50 is closer to the bottom flange 14 and is movable between a released position in which the second hinge point 50 is spaced further away from the engagement wall 16 than the first hinge point 48 and a bracing position in which the second hinge point 50 is located closer to the engagement wall 16 than the first hinge point 48.

The door brace 40 additionally comprises two hinged connection supports 52, 54 which extend between the fixed length section 44 of the leg and the engagement wall 16. The connection sections 52, 54 prevent the leg 42 from swinging in an uncontrolled manner relative to the engagement wall 16, whilst allowing controlled movement between the released position and the bracing position of the leg 42.

In use, the lever-arm 46 is raised away from the door engagement member 16, about the first hinge point 48, to allow the leg 42 to move into its released position, in which the door engagement member 16 may be located against a door, as described above. The lever-arm 46 is then lowered to bring the leg 42 into its bracing position (as shown in the drawings), in which the engagement foot 26 may be engaged with the floor. The length of the leg 42 may be adjusted by varying the length of the adjustable length section 24, as described above. The length of the leg 42 may be adjusted before or after the leg 42 is moved into its bracing position.

Figure 6:
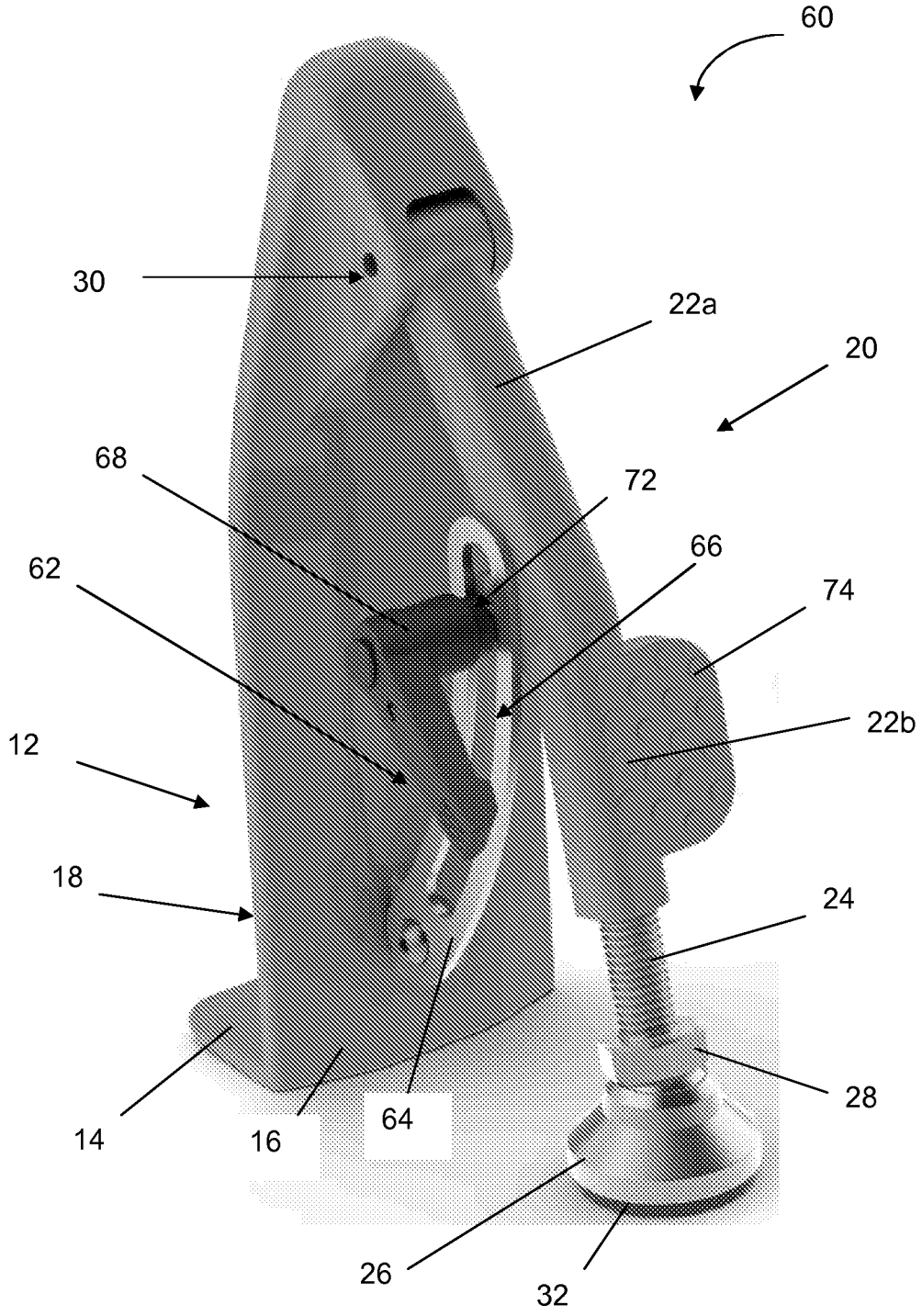
FIG. 6 is a perspective view of a door brace according to a third embodiment of the invention, in the bracing condition.

A door brace 60 according to a third embodiment of the invention is shown in FIG. 6. The door brace 60 of this embodiment is similar to the door brace 10 shown in FIGS. 1 to 3, with the following modifications. The same reference numbers are retained for corresponding features.

In this embodiment the door brace 60 further comprises an adjustable clamp 62 provided between the engagement wall 16 and the fixed length section 22*a* of the leg 20. The adjustable clamp 62 comprises an arm 64 defining a guide channel 66 arranged to receive an engagement pin 72, provided on the fixed length section 22*a* of the leg 20. A clamp lever 68 is provided on the engagement pin 72 by which the position of the engagement pin within the guide channel 66 may be fixed. The door brace 60 also comprises a kick plate 74, provided on the second part 22*b* of the fixed length section of the leg.

In use, as the leg 20 is moved from its released position into its bracing position, the engagement pin 72 slides along the guide channel 66, generally away from the engagement wall 16, thereby guiding the leg 20 towards the bracing position. The leg 20 is moved beyond its bracing position and the door engagement member 12 is located against a door, as described above. The leg 20 is then pushed back towards the door, by a user kicking the kick plate 74, to move the leg 20 into the bracing position.

Once the leg 20 is in the bracing position, the clamp lever 68 is adjusted to fix the position of the pin 72, and to retain the leg 20 in the bracing position. The arm 64 also provides increased engagement between the leg 20 and the engagement wall 16, acting to stabilise the position of the leg 20.

The invention claimed is:

1. A door brace comprising:

a door engagement member comprising a bottom flange adapted for location under a bottom edge of a door and an engagement wall extending upwardly from the bottom flange, the engagement wall having one face adapted for location against part of one side of the door;

a leg comprising a fixed length section and an adjustable length section at a distal end of the fixed length section, the fixed length section having one end hingedly connected to an opposite face of the engagement wall, the opposite face opposite the one face of the engagement wall, such that the leg is moveable between a bracing position in which the leg extends at a first angle to the engagement wall and a released position in which the leg extends at a second, smaller angle to the engagement wall, and wherein the adjustable length section has a length adjustable between a first length and a second, longer length; and an engagement foot at a distal end of the adjustable length section of the leg;

wherein the door brace has a bracing condition in which the leg is in the bracing position and the adjustable length section of the leg has the second, longer length and a released condition in which the leg is in the released position and the adjustable length section of the leg has the first length;

wherein the fixed length section of the leg is substantially straight and the door brace further comprises a lever arm, the lever arm hingedly connected at a first hinge point to the opposite face of the engagement wall, the opposite face opposite the one face of the engagement wall, and the fixed length section of the leg hingedly connected at a second hinge point to the lever arm, the lever arm moveable between an open position in which the leg is in the released position and a locked position in which the leg is in the bracing position; and wherein the second hinge point is closer to the engagement wall than the first hinge point.

2. The door brace of claim 1, wherein the fixed length section of the leg extends at an angle.

3. The door brace of claim 2, further comprising an adjustable clamp.

4. The door brace of claim 1, wherein the engagement wall and the bottom flange of the door engagement member define an L-shaped recess for receiving part of a door at a bottom edge of the door.

5. The door brace of claim 1, wherein the engagement foot has a sole including a non-slip material.

* * * * *